United States Patent [19]

Page

[11] Patent Number: 4,771,207

[45] Date of Patent: Sep. 13, 1988

[54] DISCHARGE LAMP ASSEMBLY

[75] Inventor: Robert B. Page, Leicester, England

[73] Assignee: Thorn EMI plc, London, England

[21] Appl. No.: 930,095

[22] Filed: Nov. 13, 1986

Related U.S. Application Data

[63] Continuation of Ser. No. 632,002, Jul. 18, 1984, abandoned.

[30] Foreign Application Priority Data

Aug. 13, 1983 [GB] United Kingdom ..... 8321848

[51] Int. Cl.[4] ..... H01J 9/32; H01J 61/36

[52] U.S. Cl. ..... 313/25; 313/113; 313/623; 445/33; 445/69

[58] Field of Search ..... 313/25, 113, 626, 623; 445/26, 33, 69

[56] References Cited

U.S. PATENT DOCUMENTS

| | | | |
|---|---|---|---|
| 455,069 | 6/1891 | Tesla | 313/626 |
| 2,003,493 | 6/1935 | Rentschler et al. | 313/626 |
| 2,192,892 | 3/1940 | Brandt | 313/626 |
| 2,904,710 | 9/1959 | Beeninga et al. | 313/25 |
| 2,984,385 | 5/1961 | Ovacek et al. | 445/69 |
| 3,341,731 | 9/1967 | Wilson | 445/26 |
| 3,422,300 | 1/1969 | Knochel et al. | 313/626 |
| 3,519,865 | 7/1970 | Weston | 313/626 |
| 3,849,691 | 11/1974 | Collins | 313/318 |
| 4,109,175 | 8/1978 | Watarai et al. | 313/112 |
| 4,437,038 | 3/1984 | Link et al. | 313/626 |
| 4,463,277 | 7/1984 | DeCaro | 313/25 |

FOREIGN PATENT DOCUMENTS

| | | | |
|---|---|---|---|
| 0066851 | 5/1980 | Japan | 313/626 |
| 497822 | 12/1938 | United Kingdom . | |
| 1149022 | 4/1969 | United Kingdom . | |
| 1569366 | 6/1980 | United Kingdom . | |

*Primary Examiner*—David K. Moore
*Assistant Examiner*—K. Wieder
*Attorney, Agent, or Firm*—Fleit, Jacobson, Cohn & Price

[57] ABSTRACT

In double ended high pressure discharge lamps such as are used in sealed beam reflectors the leads pass through the reflector bowl close to the axis thereof and close to each other giving risk of flashover therebetween, particularly with the high voltages required for hot restarting. To reduce such effects at least one of the leads has a length forming part of a circle terminating at one end and a sleeve of insulating refractory material conforming generally to the same circle is fitted to at least part of the circular part.

5 Claims, 1 Drawing Sheet

DISCHARGE LAMP ASSEMBLY

This application is a continuation of application Ser. No. 632,002, filed July 18, 1984, now abandoned.

This invention relates to high pressure discharge lamps, more particularly, but not exclusively to sealed beam reflector type discharge lamps. In such lamps the discharge arc tube which is usually double ended is disposed within a shallow parabolic or elliptical reflector bowl to which a top cover is sealed. As a matter of convenience the reflector bowl is manufactured such that electrical lead members have to pass through the reflector bowl disposed a short distance apart about the central axis of the reflector bowl and much closer together than the ends of the electrical lead members attached to the discharge tube. Consequently there is a much greater chance of flashover or arc over occurring between the electrical lead members in the region where they pass through the reflector bow. Since high pressure discharge lamps can require voltage pulses as high as 35 KV to re-start them when they are hot, the risk of arc over is high.

An object of this invention is to provide a design of discharge lamp alleviating this problem.

According to the present invention there is provided a discharge lamp assembly comprising an outer envelope, a discharge arc tube disposed within the outer envelope having electrodes for sustaining a discharge therebetween, at least two electrical lead members within the envelope electrically connected to respective electrodes at least one of said electrical lead members serving also to support the discharge arc tube within the envelope and, wherein between first and second ends of at least one of said electrical lead members a length of said electrical lead member is made to form part of a circle terminating either at said first or second end and a sleeve of insulating refractory material is fitted therearound along a predetermined length of said circular part.

According to a further aspect of the invention there is provided a method of assembling a discharge lamp comprising the steps of:

providing a discharge arc tube;

providing an outer envelope in which the discharge tube is to be disposed;

providing an electrical lead member;

forming a predetermined length of said electrical lead member around a predetermined radius to form part of a circle;

forming a predetermined length of insulating refractory sleeve material to fit around at least a substantial part of the circular part of the electrical lead member;

sliding the curved length of insulating refractory material onto said predetermined length of said electrical lead member bent to form part of said circle; and disposing said electrical lead member within said outer envelope to support said arc tube.

The shielding of current conductors by some kind of insulating material to prevent arc over between the conductors is known. In a particular known example involving curved quartz sleeves the straight current conductor is fed into a straight length of quartz tube. The quartz tube is then heated and bent to the required curvature and because the current conductor is made of flexible strands it simply takes up the shape of the bent quartz tube. In this known example the quartz tube also has to be heated to be fused to the pinch seal of the discharge arc tube. In the present case this is not possible because the current conductor has to be sufficiently malleable and of sufficient cross sectional area that it can be bent to the required shape to support and position the discharge arc tube within the reflector bowl as well as acting as a current conductor. Attempts to coat the current conductor with some kind of insulating coating have not been successful because of the expansion problems encountered due to the high temperature within the lamp envelope.

In the present invention it is necessary to provide a single shield or insulating sleeve only but it is preferable to have two current conductors/arc tube supports with each conductor having an insulating covering in accordance with the present invention.

The invention will now be described by way of example only and with reference to the accompanying drawings wherein.

Figures 1, 2, 3:
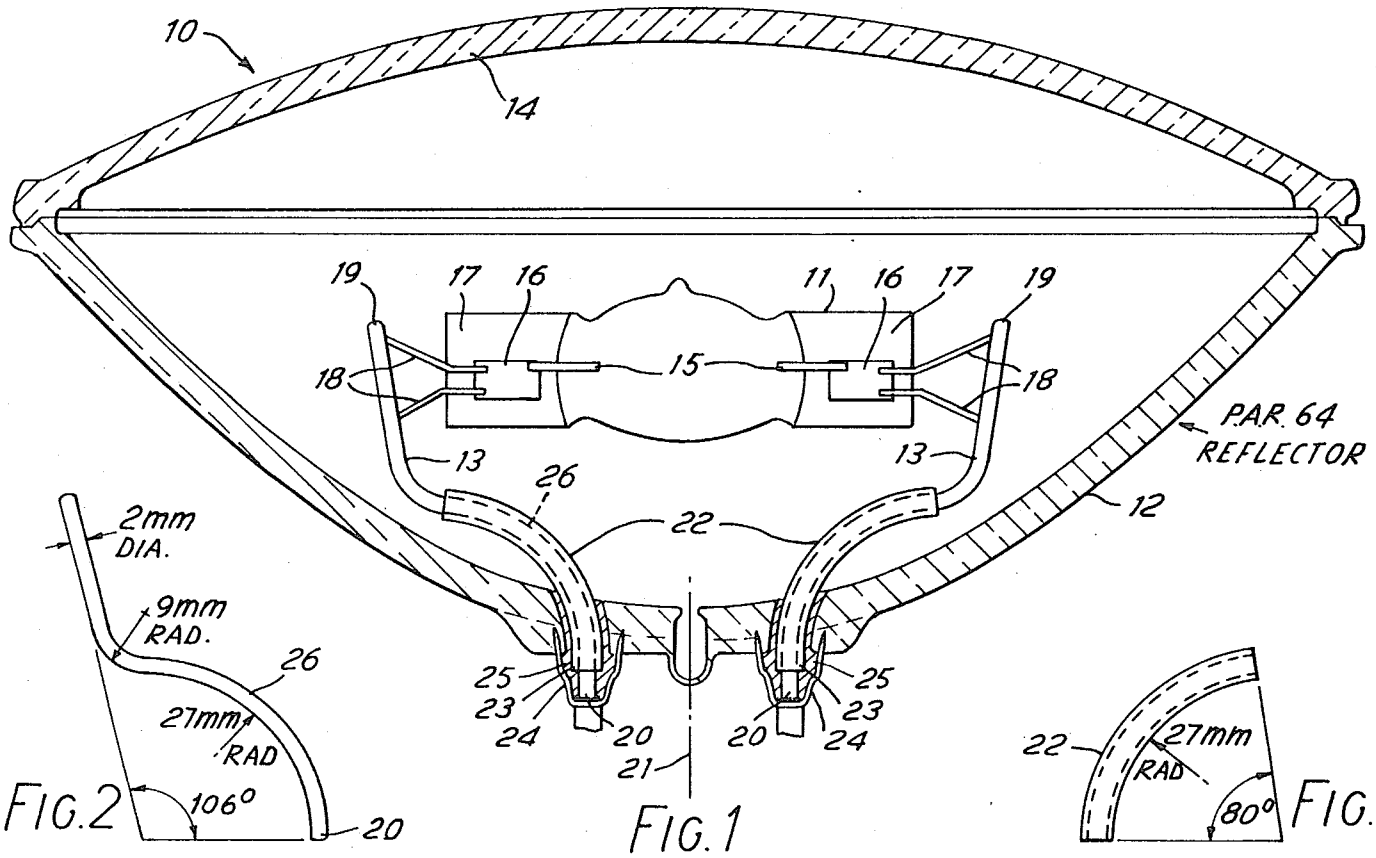
FIG. 1 is a part sectional elevation through a discharge lamp according to the invention.
FIG. 2 is a view of an insulating sleeve of refractory material in accordance with the present invention.
FIG. 3 is a view of an insulating sleeve of refractory material in accordance with the present invention.

In FIG. 1 reference numeral 10 represents one embodiment of a sealed beam reflector lamp according to the invention. In this case the lamp is an 800 watt Graph X lamp which is a lamp specially developed for the printing industry in which the double ended discharge tube 11 has a fill which includes iron, gallium and mercury. The discharge arc tube 11 is supported and positioned within an outer envelope 12, in this case a borosilicate glass reflector bowl, by electrical lead members 13 and the lamp assembly is completed by a borosilicate glass top cover 14 sealed to the envelope 12. The arc discharge tube 11 has the usual electrodes 15, foils 16 sealed in pinch seals 17 and electrode inleads 18 connected to electrical lead members 13. The glass reflector bowl optionally can be coated with a dichroic layer producing a reflector for selective radiation or an alluminium coating. The top cover 14 optionally can be a prismatic lens and by positioning the discharge arc tube near the primary focus of the reflector radiation can be diffused through the prismatic lens at the front of the reflector and a very uniform beam of light is produced.

As can be seen clearly from FIG. 1 electrical lead members 13, 13 have first ends 19, 19 to which is attached electrode inleads 18 and a second ends 20, 20 passing through the reflector bowl 12. The second ends 20, 20 are equally spaced about the central axis 21 of the lamp 10 and are very much closer spaced than the first ends 19, 19 consequently under a high starting voltage pulse, say for example, about 35 kV which is necessary to re-strike the lamp when it is hot, there is a much greater risk of arc over occurring between the second ends 20, 20 than between the first ends 19, 19.

This problem of arc over can be solved by the provision of sleeves 22 of insulating refractory material, preferably quartz, which fit around the lower portions of the electrical lead members 13 as best seen in FIG. 1. The second ends 20 of the leads 13 are brazed to the inside of external conductor cups 24 and the bottom ends 23 of the quartz sleeves 22 are set into external conductor cups 24, very conveniently by a refractory cement 25, such as for example sauereisen. The metal external conductors 24 are fused to the outer envelope 12.

Lamp assembly can take place very conveniently as follows. A straight length of electrical lead member 13 is bent to form a part of a circle as best seen in FIG. 2. For clarity it is emphasised that a part of a circle is to be interpreted as a curve of substantially constant radius. This shows the arc of the circle to be not much more than ninety degrees and extending through 106° and taking up roughly half the length of lead member 13 and with the circular part terminating at the second end 20. In a separate operation a length of quartz tubing is heated and bent about the same constant radius to form a part of the same circle as the lead 13, as shown in FIG. 3, but over a shorter arc distance and through only 80°. The dimensions of the tubular quartz sleeve 22 are chosen such that it can be easily pushed onto and along to the curved part 26 of the lead member 13 which it would not do if the curved part 26 did not terminate at second end 20; lead members 13 are attached to the electrode inleads 18 of the discharge arc tube sleeve members 22 are slid onto the curved part 26 and because they are somewhat shorter in length than the curved part 26 the ends 20 of the curved part of the lead members 13 are left exposed and are pushed home through the reflector bowl and brazed into the receptacle formed by the external electrical conductor cups 24 which can be additionally filled with sauereisen cement. Before the cement is properly set the bottom ends 23 of curved sleeves 22 can also be set into the sauereisen cement to insulate completely lead member 13 at ends 20. Although one insulating sleeve 22 only is essential to prevent arc over it is preferred to employ two such sleeves.

The assembly of the lamp component is the manner described above provides an extremely simple method of insulating the current conductors which supply the arc tube with current and also serve to support and position it within the reflector envelope. The method avoids the problems associated with attempting to work metal and quartz simultaneously, particularly in view of the notorious difficulty and high temperatures required when working with quartz. Although the embodiment described above utilises quartz sleeves clearly other insulating and temperature resistant refractory material could be used, for example, high melting point aluminosilicate and borosilicate glass or ceramics.

In a typical embodiment according to the invention the lamp assembly comprised an 800 W Graph X with an '8' diameter PAR 64 reflector or outer envelope. The lead member 13, comprises 2 mm diameter NIMONIC 90 wire material and its length prior to bending was approximately 60 mm. The curved part was bent around a 27 mm constant radius and the arc length comprised 106°. It should be noted that while 2 mm diameter NIMONIC wire has been used it is considered that a diameter of only 0.5 mm would be the minimum which could be used. Anything smaller than this would not be expected to be malleable enough to be bent to the required shape and strong enough to maintain that shape due to the thermal cycling of the lamp and still adequately support the arc tube. The quartz insulating sleeve 22 is made from 4 mm outside diameter by 0.75 mm wall thickness tube and was also bent around a 27 mm diameter curve but only over an angle of 80°.

In order to practice the invention it is not essential that the insulating sleeve lies exactly on the same radius as the electrical lead member, nor indeed, is it essential that the two components lie co-axially. This depends very much on the relative dimensions and the fit between the two components.

I claim:

1. A high pressure discharge lamp assembly comprising an outer envelope, a pair of external electrical connectors each comprising an electrically conductive receptacle fused to the lamp envelope, a high pressure arc discharge tube disposed within the envelope and having two electrodes for sustaining a discharge therebetween, two rigid, self-supporting electrical lead members supporting the discharge lamp therebetween, each lead member having an inner end connected electrically to a respective electrode and an outer end, the outer ends of the two lead members being in close-spaced relationship in comparison with the spacing of the inner ends, and the lead members being curved at least from an intermediate portion thereof to the outer ends thereof, and a respective rigid, preformed curved sleeve of an insulating refractory material positioned on the curved part of each lead member, the radius of curvature of the sleeve being similar to that of the curved part of the lead member and the length of the sleeve being substantially less than that of the curved part of the lead member such that the sleeve can be pushed onto, and slid along, the curved part, and wherein the outer end of each lead member is connected electrically to a respective receptacle and the associated sleeve has an outer end which encloses the outer end of the lead member and is secured in the receptacle by a fractory cement.

2. A discharge lamp assembly according to claim 1 comprising a sealed beam reflector discharge lamp assembly capable of utilising a starting voltage of at least 35 kV.

3. A method of assembling a high pressure discharge lamp including the steps of:

providing a high pressure discharge arc tube having two electrodes for sustaining a discharge therebetween, providing an outer envelope in which the discharge arc tube is to be disposed, the envelope having a pair of external electrical connectors each comprising an electrically conductive receptacle fused to the envelope, providing two, rigid self-supporting electrical lead members, each having an inner end and an outer end and being curved at least from an intermediate portion thereof to the outer end thereof, providing two, rigid, preformed curved sleeves of an insulating, refractory material, the radius of curvature of each sleeve being similiar to that of the curved parts of the lead members and the length of the sleeves being substantially less than that of the curved parts of the lead members, connecting the inner end of each lead member to a respective discharge electrode of the discharge arc tube, sliding each sleeve, in one-direction, onto a respective lead member to expose the outer end of the lead member, positioning the discharge arc tube within the envelope and electrically connecting the outer end of each lead member to a respective receptacle such that the outer ends are in close-spaced relationship in comparison with the spacing of the inner ends thereof, sliding each sleeve, in the opposite direction, to enclose the outer end of the respective lead member and securing the sleeve in the receptacle using a refractory cement.

4. A discharge lamp assembly comprising an outer envelope, a discharge arc tube disposed within the outer envelope and having electrodes for sustaining an electrical discharge therebetween, two electrical lead members within the envelope, each electrical lead member having a first end, connected electrically to a respective electrode, and a second end, and each electrical lead member supporting the discharge arc tube within the envelope, wherein between the first end and the second end of each said electrical lead member a predetermined length of the lead member is formed on part of a circle terminating at said second end, and a respective, rigid, preformed, curved sleeve of an insulating refractory material is positioned on the circular part of each lead member, the radius of curvature of the sleeve being similar to that of the circular part of the lead member and the dimensions of the sleeve being such that said sleeve can be pushed onto, and slid along, said circular part, and further comprising a pair of external electrical connectors, each connector comprising an electrically conductive receptacle fused to the envelope and each said second end being connected electrically to a respective receptacle, the associated sleeve enclosing the second end and being retained in the receptacle by a refractory cement.

5. A method of assembling a discharge lamp including the steps of providing a discharge arc tube, providing an outer envelope in which the discharge arc tube is to be disposed, the envelope having a pair of external electrical connectors each comprising an electrically conductive receptacle fused to the envelope, providing a pair of electrical lead members each having a first end and a second end and each being formed, over a predetermined length of the lead member, terminating at one of said first and second ends, on part of a circle, providing a respective rigid sleeve of an insulating, refractory material formed with a curve to fit around a substantial part of said predetermined length of each lead member, connecting each lead member to a respective electrode of the discharge arc tube, sliding each sleeve, in one direction, onto a respective lead member to expose said one end, disposing the discharge arc tube in the envelope and connecting said one end of each lead member to a respective electrically conductive receptacle, sliding each sleeve, in the opposite direction, to enclose said one end and retaining the sleeve in the respective receptacle using a refractory cement.

* * * * *